US011248427B2

(12) United States Patent
Mauchien et al.

(10) Patent No.: US 11,248,427 B2
(45) Date of Patent: Feb. 15, 2022

(54) SYSTEMS AND METHODS FOR MANIPULATING WELLBORE COMPLETION PRODUCTS

(71) Applicant: Schlumberger Technology Corporation, Sugar Land, TX (US)

(72) Inventors: Thomas Mauchien, Sugar Land, TX (US); Mark Milkovisch, Cypress, TX (US); Anthony Westphal, Peabody, MA (US); Brandon Christa, Richmond, TX (US); Todor Sheiretov, Houston, TX (US); Wade DuPree, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/222,620

(22) Filed: Dec. 17, 2018

(65) Prior Publication Data

US 2020/0040679 A1 Feb. 6, 2020

Related U.S. Application Data

(60) Provisional application No. 62/733,346, filed on Sep. 19, 2018, provisional application No. 62/715,186, filed on Aug. 6, 2018.

(51) Int. Cl.
*E21B 34/14* (2006.01)
*E21B 23/01* (2006.01)
(Continued)

(52) U.S. Cl.
CPC ..... *E21B 23/01* (2013.01); *E21B 17/1021* (2013.01); *E21B 47/09* (2013.01)

(58) Field of Classification Search
CPC .... E21B 23/001; E21B 17/1021; E21B 23/01; E21B 23/00; E21B 23/02; E21B 34/14
See application file for complete search history.

(56) References Cited

U.S. PATENT DOCUMENTS 3,160,836 A 12/1964 Farley
3,420,306 A 1/1969 Brown
(Continued)

FOREIGN PATENT DOCUMENTS

DE 29815317 U1 11/1998
WO 1998017974 A1 4/1998

OTHER PUBLICATIONS

International Search Report and Written Opinion issued in the related PCT Application PCT/US2019/044624, dated Nov. 14, 2019 (13 pages).

(Continued)

*Primary Examiner* — Kipp C Wallace
(74) *Attorney, Agent, or Firm* — Ashley E. Brown

(57) ABSTRACT

A service tool that may be inserted into a tubular, the service tool includes an anchoring system. The anchoring system includes a body having a first end, a second end, and an opening extending along a portion of the body between the first end and the second end and a gripping assembly housed within and coupled to the body. The gripping assembly may anchor at least a portion of the service tool to the tubular, and the gripping assembly includes a plurality of anchor arms disposed within the opening and that may move relative to the body. The anchoring system also includes an actuator disposed within a central bore of the body and coupled to the gripping assembly. The actuator may apply a first axial input force in a first direction and a second axial input force in a second direction opposite the first direction to the gripping assembly, At least a portion of the gripping assembly translocates relative to the body in the first direction in response (Continued)

to the first axial input force to position the plurality of anchor arms in a radially expanded anchoring configuration, and the portion of the gripping assembly translocates relative to the body in the second direction in response to the second axial input force to position the plurality of anchor arms in a radially contracted configuration.

19 Claims, 9 Drawing Sheets

(51) Int. Cl.
*E21B 17/10* (2006.01)
*E21B 47/09* (2012.01)

(56) References Cited

U.S. PATENT DOCUMENTS 4,108,243 A * 8/1978 King ..... E21B 17/003 166/104
4,656,457 A 4/1987 Brausfeld et al.
4,879,440 A 11/1989 Lymburner
4,910,491 A 3/1990 Gottling et al.
4,941,532 A 7/1990 Hurt et al.
4,971,146 A 11/1990 Terrell
4,988,074 A 1/1991 Najmolhoda
5,137,086 A * 8/1992 Stokley ..... E21B 49/082 166/191
5,138,934 A 8/1992 Murayama et al.
5,150,049 A 9/1992 Schuetz
6,356,071 B1 3/2002 Koski et al.
6,464,003 B2 * 10/2002 Bloom ..... E21B 19/22 166/212
6,588,313 B2 7/2003 Brown et al.
6,640,894 B2 11/2003 Bloom et al.
6,715,559 B2 4/2004 Bloom et al.
6,722,260 B1 4/2004 Brown
6,722,261 B1 4/2004 Brown et al.
6,745,666 B2 6/2004 Zilioli
6,796,380 B2 * 9/2004 Xu ..... E21B 23/01 166/381
6,892,811 B2 5/2005 LaClare et al.
6,920,936 B2 7/2005 Sheiretov et al.
7,048,047 B2 5/2006 Bloom et al.
7,051,810 B2 * 5/2006 Clemens ..... E21B 41/00 166/301
7,278,482 B2 10/2007 Azar
7,334,642 B2 2/2008 Doering et al.
7,886,834 B2 2/2011 Spencer et al.
8,286,716 B2 * 10/2012 Martinez ..... E21B 33/129 166/216
10,053,937 B2 * 8/2018 Richards ..... E21B 23/065
10,544,657 B2 * 1/2020 MacDougall ..... E21B 47/092
10,648,290 B2 * 5/2020 Fears ..... E21B 23/02
2003/0173076 A1 9/2003 Sheiretov et al.
2005/0072577 A1 * 4/2005 Freeman ..... E21B 34/14 166/386
2006/0180318 A1 8/2006 Doering et al.
2009/0071659 A1 * 3/2009 Spencer ..... E21B 23/01 166/382
2010/0006279 A1 1/2010 Martinez et al.
2010/0258293 A1 * 10/2010 Lynde ..... E21B 23/06 166/66
2013/0113227 A1 * 5/2013 Mitchell ..... E21B 23/14 294/86.24
2014/0174761 A1 * 6/2014 Spencer ..... E21B 34/14 166/381
2014/0352422 A1 * 12/2014 Paulsson ..... E21B 17/1021 73/152.58
2016/0123112 A1 * 5/2016 Purkis ..... E21B 34/14 166/320
2017/0167227 A1 * 6/2017 Lee ..... E21B 31/005
2017/0175469 A1 6/2017 Murphy
2019/0017340 A1 * 1/2019 Clemens ..... E21B 23/01
2019/0271201 A1 * 9/2019 Robertson ..... E21B 23/01

OTHER PUBLICATIONS

International Preliminary Report on Patentability of International Patent Application No. PCT/US2019/044624 dated Feb. 9, 2021, 8 pages.

* cited by examiner

SYSTEMS AND METHODS FOR MANIPULATING WELLBORE COMPLETION PRODUCTS

CROSS-REFERENCE TO RELATED APPLICATIONS

This disclosure claims the benefit of and priority to U.S. Provisional Patent Application No. 62/715,186, titled "System and Methods for Shifting," filed Aug. 6, 2018; and U.S. Provisional Patent Application No. 62/733,346, titled "System and Methods for Manipulating Wellbore Completion Products," filed Sep. 19, 2018, which are incorporated by reference herein in their entireties for all purposes.

BACKGROUND

This present disclosure relates to service tools, in particular to a mechanical intervention shifting tool used to exercise, shift or remove completion products. The service tool can be used to manipulate a variety of types and sizes of completion products with a single configuration, or for expanded sizes, with minimal configuration changes. The service tool is composed of three systems: the shifter, the linear actuator, and the anchor. The shifter system is a latching mechanism that enables gripping to the completion shifting profile feature with high accuracy and reliability via on-demand control of radial load acting on the completion profile feature. The axial push/pull load is generated via the linear actuator, but can also be generated by the tractor and/or wireline cable. The anchor system provides radial loads to react to the axial loads generated by the linear actuator. Both the shifter and anchor systems use linkage designs with large expansion ratios that enable passage through small diameters and deployment into large diameters while preserving capability of generating high loads. In addition, both the shifter and anchor systems are fail-safe and are able to fully retract within the tool outer diameter in case of power loss, including in high-debris environments. In addition to fail-safe or passive close, the anchor has the capability to power close or active close. The anchor mechanism is capable of applying a constant radial load that is independent of borehole size and effects from axial loads generated by the linear actuator. The anchor mechanism is self-centralizing, enabling uniform load distribution. The service tool uses force and displacement sensors that enable accurate real-time feedback on the state of the system. This disclosure is applicable to service tools including, but not limited to, downhole and surface applications.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admission of prior art.

Many types of mechanical operations are performed in the course of maintaining and optimizing production from wells. Performing some of these operations involve application of axial forces to a downhole tool located downhole in a completion assembly. For example, isolation valves located in production tubing may be opened or closed by pushing or pulling an internal feature. In other examples, axial forces are used in the retrieval of a plug or a gas valve and in various fishing operations.

In the case of opening or closing the isolation valve, the shifter system latching mechanism is deployed and translated axially using the linear actuator system. The latching mechanism is controlled via a variable pressure system that enables accurate locating of the shifter profile feature. Once the latching mechanism is positively latched into the shifting profile feature, the latching mechanism radial load can be increased using the variable pressure system to lock the latching mechanism to the shifting profile feature. After the latching mechanism is locked to the shifting profile feature, the anchor system gripping mechanism is deployed to apply a radial load to the tubular to react to the axial push and pull loads that are generated by the linear actuator system. Once the anchor system is anchored, the linear actuator is deployed to apply the push and/or pull load to move the shifting profile feature hence either opening or closing the isolation valve.

SUMMARY

A summary of certain embodiments disclosed herein is set forth below. It should be understood that these aspects are presented merely to provide the reader with a brief summary of these certain embodiments and that these aspects are not intended to limit the scope of the present disclosure. Indeed, the present disclosure may encompass a variety of aspects that may not be set forth below.

This present disclosure relates to service tools, in particular mechanical intervention shifting tool used to exercise, shift or remove completion products. The service tool can be used to manipulate a variety of types and sizes of completion products with a single configuration, or for expanded sizes, with minimal configuration changes. The service tool is composed of three systems: the shifter, the linear actuator, and the anchor. The shifter system is a latching mechanism, which enables gripping to the completion shifting profile feature with high accuracy and reliability via on-demand control of radial load acting on the completion profile feature. The axial push/pull load is generated via the linear actuator but can also be generated by the tractor and/or wireline cable. The anchor system provides radial loads to react to the axial loads generated by the linear actuator. Both the shifter and anchor systems use linkage designs with large expansion ratios that enable passage through small diameters and deployment into large diameters while preserving capability of generating high loads. In addition, both the shifter and anchor systems are fail-safe and are able to fully retract within the tool outer diameter in case of power loss, even in high-debris environments. In addition to fail-safe or passive close, the anchor has the capability to power close or active close. The anchor mechanism may apply a constant radial load that is independent of borehole size and effects from axial loads generated by the linear actuator. The anchor mechanism is self-centralizing, enabling uniform load distribution. The service tool uses force and displacement sensors which enable accurate real-time feedback on the state of the system. This disclosure is applicable to service tools including, but not limited to, downhole and surface applications.

A service tool that may be inserted into a tubular, the service tool includes an anchoring system. The anchoring system includes a body having a first end, a second end, and an opening extending along a portion of the body between the first end and the second end and a gripping assembly housed within and coupled to the body. The gripping assembly may anchor at least a portion of the service tool to the tubular, and the gripping assembly includes a plurality of anchor arms disposed within the opening and that may move relative to the body. The anchoring system also includes an actuator disposed within a central bore of the body and coupled to the gripping assembly. The actuator may apply a first axial input force in a first direction and a second axial input force in a second direction opposite the first direction to the gripping assembly, At least a portion of the gripping assembly translocates relative to the body in the first direction in response to the first axial input force to position the plurality of anchor arms in a radially expanded anchoring configuration, and the portion of the gripping assembly translocates relative to the body in the second direction in response to the second axial input force to position the plurality of anchor arms in a radially contracted configuration.

A service tool that may be inserted into a borehole, the service tool including a shifter assembly. The shifter assembly includes a latching mechanism having a plurality of latching lengths that may latch at least a portion of the service tool to a completion component latch or shifting profile geometry. The service tool also includes a first piston disposed within a body of the service tool at a first end and a second piston disposed within the body of the service tool at a second end that is opposite the first end. The first piston floats within the body such that the first piston is not in contact with the body at the first end and the second piston bottoms out at the second end when the service tool moves the completion component latch in a first direction, and the second piston floats within the body such that the second piston is not in contact with the body at the second end and the first piston bottoms out on at the first end when the service tool moves the completion component latch in a second direction that is opposite the first direction.

A method for seeking and latching a service tool into a shifting profile geometry, the method includes inserting an intervention service tool into a tubular in a hydrocarbon reservoir. The intervention service tool includes an anchoring system, a shifting system, and a linear actuator system, and the shifting profile geometry is disposed within the tubular at a first location. The method also includes positioning the shifting system above or below the shifting profile geometry and actuating a latching mechanism of the shifting system. Actuating the latching mechanism includes applying an axial input force to the latching mechanism using the linear actuator system, the axial input force radially expands or radially contracts latching lengths of the latching mechanism, and the latching lengths exert a radial force when actuated. The method also includes adjusting the radial force exerted by the latching lengths to locate the shifting profile geometry. The latching mechanism is compliant to inner dimensions of the tubular when the shifting profile is being located. The method also includes locking the shifting system to the shifting profile geometry. The radial force exerted by the latching lengths is increased to lock the shifting system to the shifting profile geometry. The method further includes positioning the shifting profile geometry at a second location that is different from the first location and removing the intervention service tool from the tubular after positioning of the shifting profile geometry at the second location.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

One or more specific embodiments of the present disclosure will be described below. These described embodiments are examples of the presently disclosed techniques. Additionally, in an effort to provide a concise description of these embodiments, features of an actual implementation may not be described in the specification. It should be appreciated that in the development of any such actual implementation, as in any engineering or design project, numerous implementation-specific decisions may be made to achieve the developers' specific goals, such as compliance with system-related and business-related constraints, which may vary from one implementation to another. Moreover, it should be appreciated that such a development effort might be complex and time consuming, but would still be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As discussed in further detail below, this present disclosure relates to service tools, in particular to a mechanical intervention shifting tool used to exercise, shift or remove completion products. The service tool can be used to manipulate a variety of types and sizes of completion products with a single configuration, or for expanded sizes, with minimal configuration changes. The service tool is composed of three systems: the shifter, the linear actuator, and the anchor.

Figure 1:
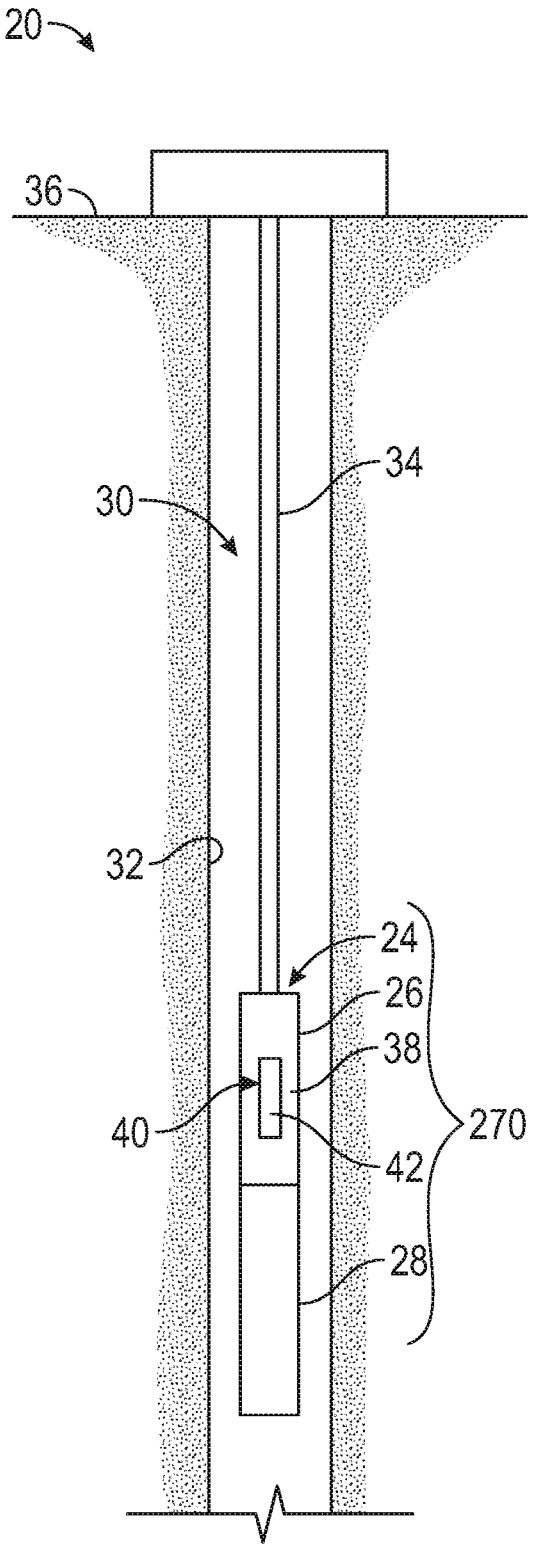
FIG. 1 is a schematic diagram of a wellsite system that may employ a service tool deployed in a completion string.

Referring generally to FIG. 1, one embodiment of a well system 20 is illustrated as having an intervention service tool 270. Embodiments of the present disclosure also include a method for reliably latching into downhole completion products (e.g., the tubular 32) using the intervention service tool 270. In addition, the disclosed method may mitigate missing a profile feature when latching into a shifting profile of the downhole completion product. The disclosed service tool 270 may be conveyed with a conveyance or an electrical line 34 that is gravity fed into a production well (e.g., the wellbore 30) or conveyed by a tractor system. However, other types of conveyances, e.g., coiled tubing or jointed pipe, also can be used to deploy the service tool 270.

Figure 2:
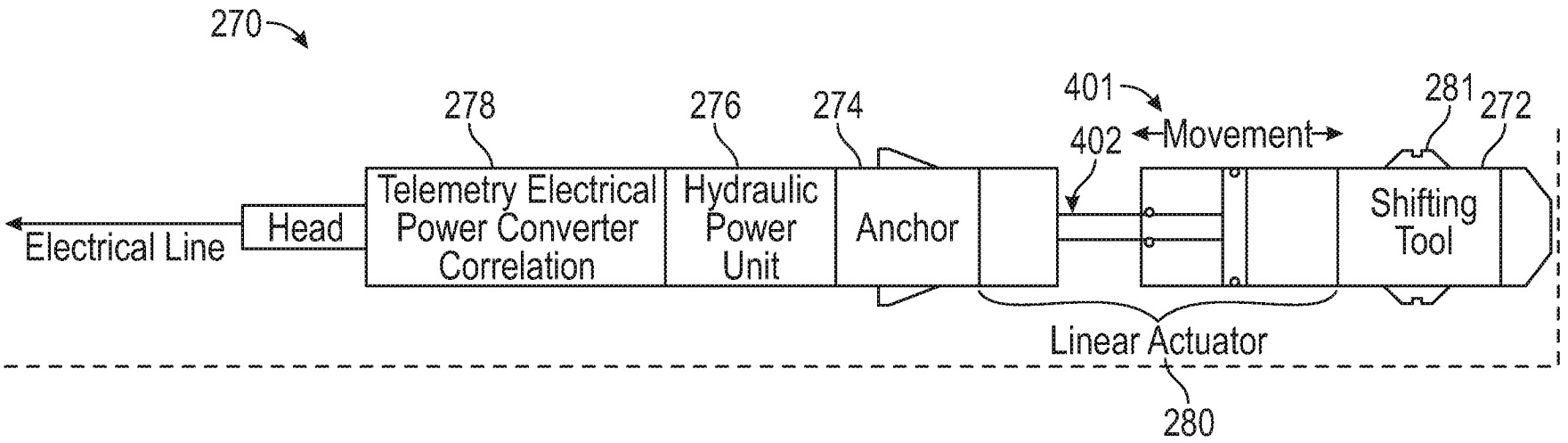
FIG. 2, is a schematic diagram of a service tool having an anchor system, a linear actuator system, and a shifter system, in accordance with an embodiment.

FIG. 2 is a diagram of an embodiment of the service tool 270 in FIG. 1 that may be fed into the well 30. In one embodiment, the service tool 270 may be a downhole hydraulic shifting service tool. The service tool 270 includes a shifting system 272, an anchoring system 274, a hydraulic power unit 276, a telemetry system 278, and a linear actuator system 280 positioned between the shifting system 272 and the anchoring system 274. The linear actuator 280 provides a push/pull force, such as the axial force 401, respectively, and may include an actuator rod 402. In certain embodiments, the service tool 270 may include a downhole tractor rather than the linear actuator 280 to provide the push/pull force. The shifting system 272 may include a latching mechanism 281 used to latch the shifting system 272 into a completion product shifting profile feature. The shifting system 272 may be deployed or retracted on command from a surface control system.

Electrical power and telemetry are provided by a surface system down through the electrical line. The electrical power is converted to other power supplies that may be used throughout the tool string (e.g., the service tool 270). The telemetry system 278 may be connected throughout the tool string to provide commands from the surface system for downhole functionality. For example, the functionality may be used to control the anchoring system 274, the linear actuator system 280, and/or the shifting system 272. The force and displacement associated with the linear actuator 280 may be measured downhole and the information from the measurement is sent to the surface to provide information related to the completion component such as an isolation valve. For example, the information associated with the linear actuator force and displacement may provide an indication as to whether the completion isolation valve is open or closed and at what speed the valve is opening and closing.

The present disclosure further generally relates to a system and method for anchoring a tool in a wellbore. The tool may be anchored within a tubular, such as a casing or an internal tubing, at any appropriate/desired location along the tubing. In some embodiments, the tool may also be anchored in an open wellbore, in which a metal tubular is not installed in the wellbore. In other embodiments, the tool may be disposed inside another tool or device, e.g. a completion valve. The system and methodology are useful with a variety of well related tools, such as service tools. For example, the anchoring system can be used to firmly anchor a service tool in a wellbore such that the service tool is able to apply axial force to allow for performance of a given operation.

The disclosed anchoring system may enable significant expansion and contraction of the anchoring tool such that a radial change allows the anchoring tool to pass through restrictions in a tubing string, for example, while enabling anchoring in a larger section below the restriction. In addition to anchoring with a keyed anchor, the system enables anchoring in featureless tubing of a variety of diameters. However, even though the anchoring tool has a large opening ratio, the tool maintains a significantly high anchoring strength.

In general, the anchoring tool functions by extending one or more anchor arms away from a housing or body until the anchoring arm or arms establish contact with an anchoring surface. Each arm applies a radial force to the anchoring surface to produce substantial traction, which anchors the tool in place. The anchoring surface may be the interior surface of a tubular structure, such as production tubing, a casing, a pipeline, an open wellbore, or another structure. The inside surface often is cylindrical in shape, but it also can have more complex geometries, e.g. triangular, rectangular, or other shapes within downhole structures. As described in greater detail below, each anchoring arm is extended outwardly through cooperation with a wedge component having one or more wedge features that act against the arms when the anchoring tool is actuated. The wedge component further supports the arms while they are engaged with the anchoring surface when the tool is in an anchoring configuration. Each anchoring arm is deployed by causing relative movement between the anchoring arm and the wedge component in one direction; and each anchoring arm is closed or allowed to close by causing relative movement in another, e.g. opposite, direction.

As discussed in further detail below, each anchoring arm extends outwardly with the assistance of the wedge component and a linkage component. The wedge component includes wedge features that may apply a force against the anchoring arms when the anchoring system is actuated. The linkage components may also apply a force against the anchoring arm through pin articulations. In addition, both the wedge and the linkage components support the anchoring arms while the anchoring arms are engaged with the anchoring surface when the tool is in the anchoring configuration. In certain embodiments, the anchoring arm may include a multi-stage scissor mechanism. Each anchoring arm is coupled to another anchoring arm via pin connections. For example, each stage of the multi-stage scissor mechanism may include two anchoring arms and a pin connection.

Referring again to FIG. 1, an embodiment of a well system 20 may further include an anchoring system 24 that includes an anchoring tool 26. In the illustrated embodiment, the anchoring tool 26 is coupled to a well tool 28, which may have a variety of forms depending on the specific well application in which the well tool 28 and the anchoring tool 26 are utilized. For example, the well tool 28 may include a service tool for performing a variety of downhole operations. The well tool 28 also may include a completion tool, a tool string, a treatment tool, or a variety of other tools deployed downhole to perform the desired operation.

In the embodiment illustrated in FIG. 1, the anchoring tool 26 and the well tool 28 are deployed downhole into a wellbore 30 within a tubular 32. By way of non-limiting example, the tubular 32 may be a well completion assembly, casing, production tubing or other downhole structure. A conveyance 34, such as a service, is used to deploy the anchoring tool 26 and the well tool 28 into the wellbore 30 from a surface location 36. However, other types of conveyances, e.g. coiled tubing or jointed pipe, also can be used to deploy the anchoring tool 26 and the well tool 28.

The anchoring tool 26 includes a structure 38 and having an anchoring mechanism 40 that includes one or more anchor arms 42 that move relative to the structure 38. For example, the one or more anchor arms 42 may move between a radially contracted configuration and a radially expanded anchoring configuration. Expansion and contraction of the one or more anchor arms 42 allow anchoring and movement, respectively, of the anchoring tool 26 within the tubular 32. For example, in the radially expanded anchoring configuration, the anchor arms 42 are in an open position to allow the anchoring tool 26 to contact an anchoring surface of the tubular 32, thereby retaining (e.g., anchoring) the anchoring tool 26 to the tubular 32. In the radially contracted configuration, the anchor arms 40 are in a closed position away from the tubular 32 such that the anchoring tool 26 may move relative to the tubular 32.

Figure 3:
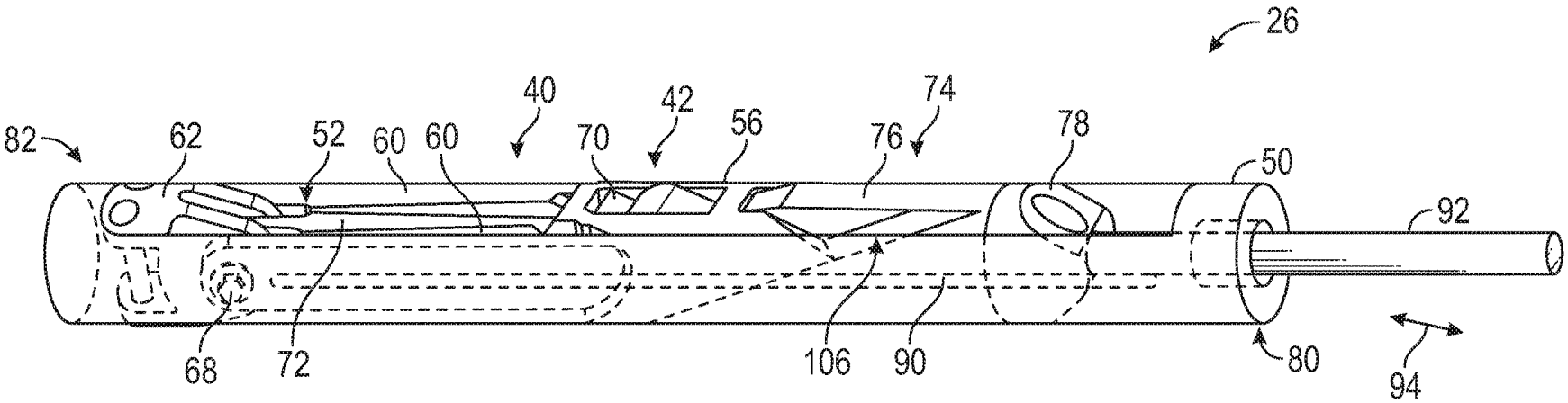
FIG. 3 is a perspective view of the anchor system of FIG. 2, the anchoring system includes a body for housing a gripping assembly, in accordance with an embodiment.

FIG. 3 illustrates an embodiment of the anchoring tool 26 in which the anchor arms 42 are in the radially contracted or closed configuration. In the illustrated embodiment, the anchoring tool 26 includes a body 50 having an opening 52 sized to receive the anchor mechanism 40. The body 50 may have any suitable geometric shape that facilitates deployment and retrieval of the anchoring tool 26. For example, in the illustrated embodiment, the body 50 is cylindrical. However, in other embodiments, the body 50 may be rectangular, polygonal, or any other suitable geometric shape. In the radially contracted configuration, the anchor arms 42 are substantially contained within the body 50. Containment of the anchor mechanism 40 within the body 50 allows the anchoring tool 26 to pass through restrictions in the tubular 32 and may keep the anchoring tool 26 from becoming caught or hung up on features within the tubular 32 during deployment or retrieval of the anchoring tool 26.

Figure 4:
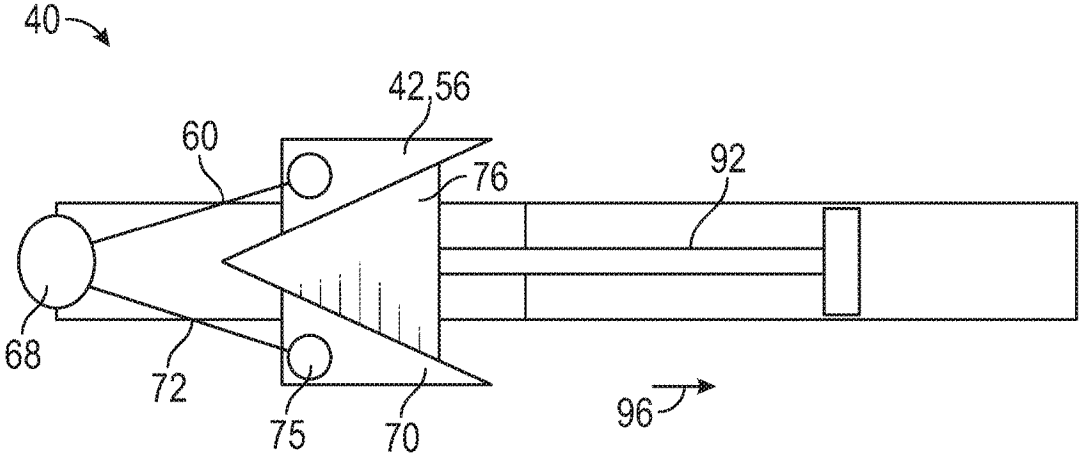
FIG. 4 is a perspective view of the anchoring mechanism of FIG. 2 showing an outer pad of the anchor arm, whereby the anchor arms are in a radially expanded configuration, in accordance with an embodiment.

The anchor arms 42 each include features that facilitate radial movement of the anchor mechanism 40 relative to the body 50. For example, each anchor arm 42 includes an outer pad 56 and a pair of outer linkages 60 that couple the outer pad 56 to a pivot base 62 via a pivot pin 68. In addition, each anchor arm 42 includes an inner pad 70 and an inner linkage 72 that couples the inner pad 70 to the pivot base 62 via an inner pad pin 75 (see FIG. 4) and the pivot pin 68. The pivot base 62 is constrained with respect to the body 50. That is, the pivot base 62 is fixed onto the body 50.

In addition to the anchor arm 42, the body 50 may also house other components of the anchoring mechanism 40. For example, the anchoring mechanism 40 includes a wedge component 74 having a wedge 76 and a wedge cap 78 positioned within the opening 52 and adjacent to a first end 80 of the anchoring tool 26. The first end 80 is substantially opposite a pivoting end of the 82 of the anchoring mechanism 40. As discussed in further detail below, the wedge 76 may interact with a radially inward surface of the anchor arm 42 to facilitate radial expansion of the anchor arm 42. For example, the wedge 76 may move relative to the body 50 such that the wedge 76 engages with the radially inward surface of a respective anchor arm 42 to move the anchor arm 42 from a radially contracted configuration to a radially expanded configuration.

Movement of the wedge 76 may be guided in translation with respect to the body 50 by a pair of slot keys 90 and an actuator rod 92. In certain embodiments, the actuator rod 92 may also translate with relative to the body 50. The actuator rod 92 provides axial input force (e.g., push or pull) to the anchoring mechanism 40. For example, the actuator rod 92 transfers a first axial input force 94 (e.g., push) to the wedge 76 to radially move the pads 56, 70 and the linkages 60, 72 with respect to the body 50 to the radially expanded configuration. Conversely, the actuator rod 92 provides a second axial input force 96 (e.g., pull) to the wedge 76 to radially move the pads 56, 70 and the linkages 60, 72 with respect to the body 50 to the radially contracted configuration.

The anchoring mechanism 40 may be back-drivable due, in part, to friction and a selected angle for the ramp 106. That is, if the first axial input force and the radial, or output, force are reversed, the anchoring mechanism 40 would radially contract. For example, if an input force (e.g., the second axial input force 96) is exerted on the pads 56, 70 radially and inwardly, the pads 56, 70, the linkages 60, 72, and the wedge 76 cause the anchoring mechanism 40 to radially contract, or close. Therefore, the wedge 76 translates relative to the body 50 and moves away from the pivot end 82 toward a closed position. As such, the anchoring mechanism 40 may prevent the anchoring tool 26 from becoming caught or stuck within the tubular 32 during downhole operations. For example, when the radial force is applied to the tubular 32, the tubular 32 may deform elastically and store energy. Accordingly, the tubular 32 may behave similar to a compressed spring. Once the first axial input force 94 applied by the actuator rod 92 is released, the tubular 32 may exert an inward radial force that radially contracts the pads 56, 70 and the linkages 60, 72 and axially translocates the wedge 76, thereby retracting the anchoring mechanism 40. The radial translation of the pads 56, 70 enable a large surface of contact (e.g., between approximately 30% and 95%) to be established between the pads 56, 70 and the tubular 32. Therefore, the load may be spread across a larger surface area and local stresses, deformations, and damage to the tubular 32 may be decreased compared to existing anchoring mechanism.

Figure 5:
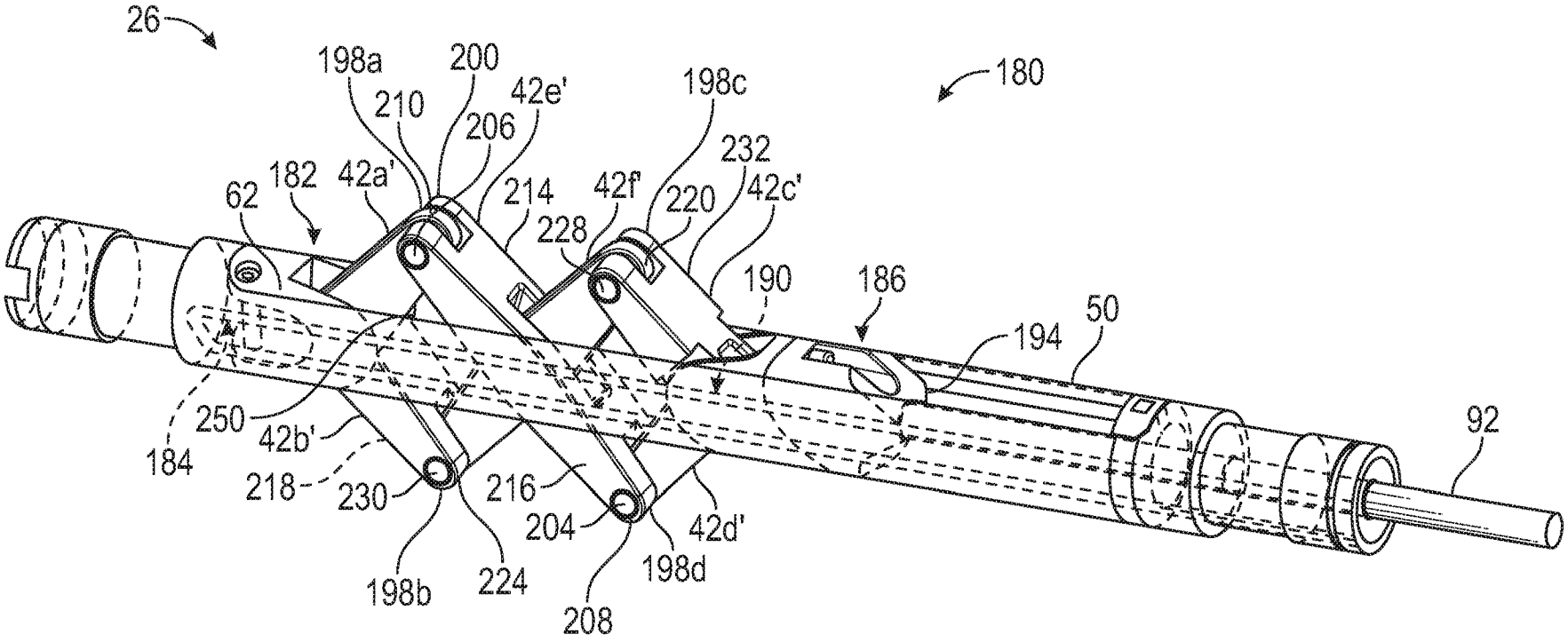
FIG. 5 is a perspective view of the anchor system of FIG. 2 having a gripping assembly with anchor arms in a radially expanded configuration, in accordance with an embodiment.

In certain embodiments, the anchoring tool 26 may include an anchoring mechanism having a multi-stage scissor mechanism. For example, FIG. 5 is a perspective view of the anchoring tool 26 with a multi-stage scissor mechanism for anchoring a tool to the tubular (e.g., the tubular 32)

in accordance with an embodiment of the present disclosure. FIG. 5 illustrates the anchoring tool 26 in the radially expanded, or open, configuration. The multi-stage scissor anchoring mechanism 180 includes anchor arms 42*a*', 42*b*', 42*c*', 42*d*', 42*e*', 42*f*' that may radially expand or contract to anchor or release, respectively, the anchoring tool 26 to a desired tubular. The multi-stage scissor anchoring mechanism 180 may include 2, 4, 6, 8, 10, or more anchor arms 42'.

Each stage of the multi-stage scissor anchoring mechanism 180 may have anchor arms shaped like a rhombus. Each anchor arm 42' is connected to an adjacent anchor arm 42' via a pin connection. For example, first end anchor arms 42*a*', 42*b*' are coupled to one another at a first pivot end 182 via a first pin 184. The first pivot end 182 includes the pivot base 62, which is fixed to the body 50 of the anchoring tool 26. The pivot base 62 and the first end anchor arms 42*a*', 42*b*' each have an opening that facilitates coupling of the first end anchor arms 42*a*', 42*b*' to the pivot base 62. The respective openings of the pivot base 62 and the first end anchor arms 42*a*', 42*b*' are aligned such that the first pin 184 is inserted through the respective opening to couple (e.g., attach) the first end anchor arms 42*a*', 42*b*' to the pivot base 62. Similarly, second end anchor arms 42*c*', 42*d*' are coupled to one another at a second pivot end 186 via a second pin 190. The second pivot end 186 includes a second pivot base 194 fixed to the actuator rod 92 and may translate with respect to body 50. The actuator rod 92 provides axial input force (e.g., push or pull) to the anchoring mechanism 40. For example, the actuator rod 92 transfers a first axial input force 94 (e.g., push; see FIG. 3) to second pivot base 194.

Each end anchor arm 42*a*', 42*b*', 42*c*', 42*d*' includes a coupling end 198 that enables coupling to center anchor arms 42*e*', 42*f*. For example, in the illustrated embodiment, the coupling ends 198*a*, 198*d* of the end anchor arms 42*a*', 42*d*' are coupled to a coupling end 200, 204 of the center anchor arm 42*e*' via pins 206, 208, respectively. Each coupling end 200, 204 includes a slot 210 sized to fit the respective coupling end 198*a*, 198*d* of the end anchor arm 42*a*', 42*d*' such that the coupling end 198*a*, 198*b* is "sandwiched" between a first anchor arm portion 214 and a second anchor arm portion 216 of the center anchor arm 42*e*'. At least a portion of the center arm 42*f*' is also positioned (e.g., "sandwiched") between the first anchor arm portion 214 and the second anchor arm portion 216. The center arms 42*e*', 42*f*' are coupled to one another via a central pin 218.

In a similar manner, each end anchor arm 42*b*', 42*c*' is coupled to a coupling end 220, 224 of the center anchor arm 42*f*' via pins 228, 230, respectively. End anchor arms 42*b*', 42*c*' each include a slot 232 sized to fit the respective coupling end 220, 224 of the center anchor arm 42*e*', 42*d*'. As such, the coupling end 220, 224 of the center anchor arm 42*e*', 42*f* are "sandwiched" between a third anchor arm portion 240 and a fourth anchor arm portion 242 of the end anchor arm 42*b*', 42*c*'. Accordingly, in the illustrated embodiments, the two-stage scissor anchoring mechanism 180 includes a total of six anchor arms 42' and seven pins (e.g., pins 184, 190, 206, 208, 218, 228, 230), thereby coupling each anchor arm 42' to an adjacent anchor arm 42'. In one embodiment, the pin 184 is fixed onto the body 50 and the pin 190 is driven back and forth along the anchoring tool 26. As such, when the actuator rod 92 applies the first axial input force 94 (FIG. 3), the end anchor arms 42*c*', 42*d*' move toward the end anchor arms 42*a*', 42*b*'. The anchor arms 42' pivot about the respective pins 184, 190, 206, 208, 218, 228, 230 such that the anchor arms 42' radially expand away from the body 50 and toward the tubular to deploy the anchoring mechanism 180. That is, the anchor arms 42' move in a manner similar to an accordion. The anchor arms 42' may be radially contracted when the actuator rod 92 applies the second axial input force 96 (FIG. 4) to pull the anchor arms 42' away from the tubular and toward the body 50 of the anchoring tool 26, thereby retracting the anchoring mechanism 180.

As shown in FIG. 5, when the actuator rod 92 deploys the multi-stage scissor anchoring mechanism 180, the anchor arms 42' form a rhombus. Rhombus angles 250 may be between approximately 35 degrees and 60 degrees and axial and radial forces are substantially the same. The disclosed two-stage scissor anchoring mechanism 180 may have a mechanism advantage of 4 due, in part, to having four radial forces of substantially the same magnitude acting on the case as a result of the axial force. Therefore, for 1 lbf of the first axial input force there is approximately 4 lbf of anchoring radial force. As should be noted, anchoring mechanism having more than two-stages are also within the scope of the present disclosure.

Figure 6:
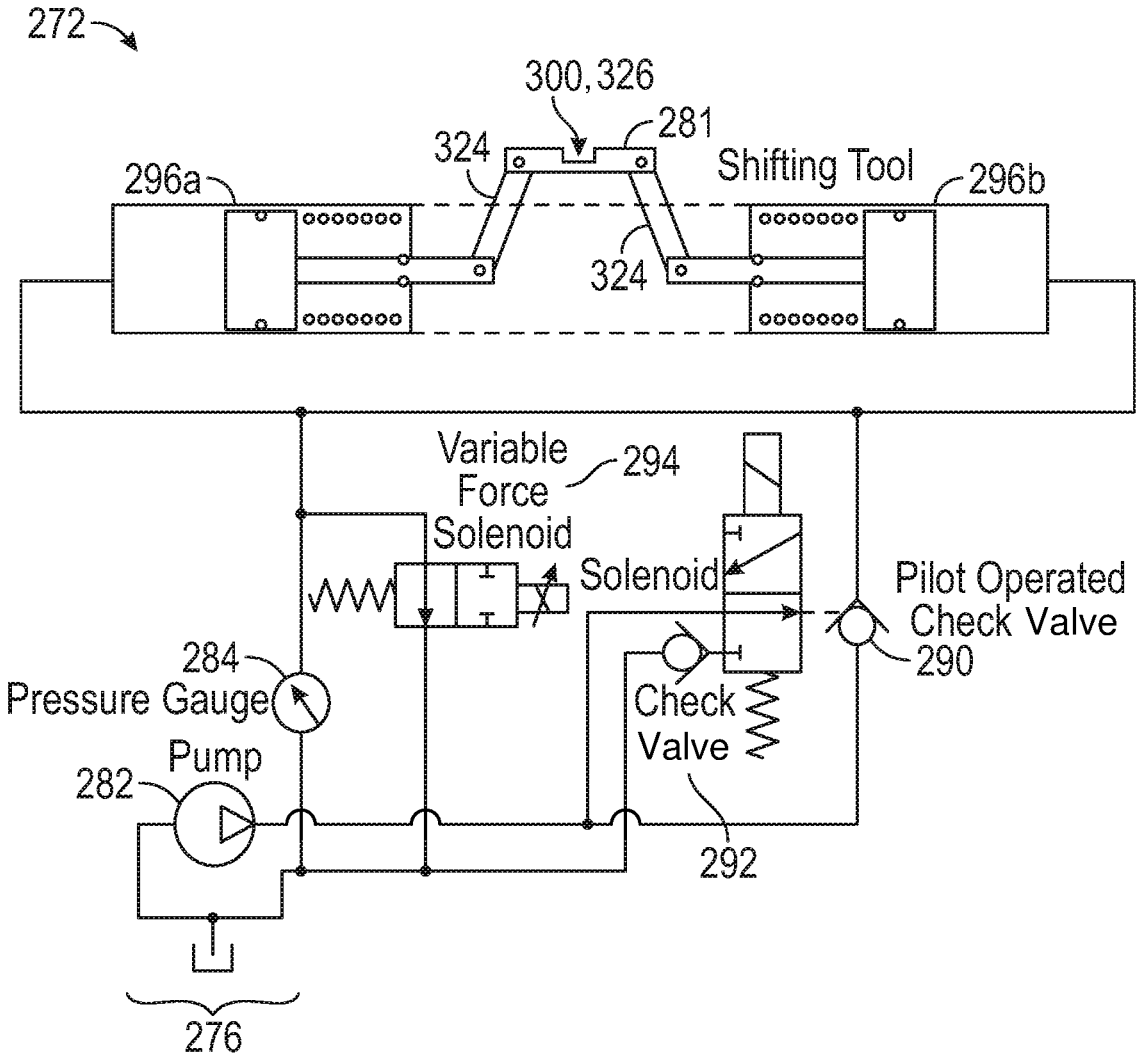
FIG. 6 is a schematic diagram of a portion of the shifter system of FIG. 2, whereby the shifter system includes a latching mechanism that is actuated via a dual floating hub system having hydraulic cylinders via a variable force solenoid operated valve, in accordance with an embodiment.

The shifting system 272 may be controlled hydraulically by a hydraulic pump within the hydraulic power unit 276 (shown in FIG. 2). For example, FIG. 6 illustrates a hydraulic schematic that may be used to hydraulically control the shifting system 272. The hydraulic system includes the hydraulic power unit having a hydraulic pump 282 and a pressure gauge 284. The hydraulic system further includes a pilot operated check valve 290, a check valve 292, and a variable force solenoid operated valve 294. The pressure gauge 284 may measure an open pressure (e.g., a flow back pressure) of the shifting system 272. The check valves 290, 292 may allow hydraulic fluid into hydraulic cylinders 296 of the shifting system 272, and the variable force solenoid operated valve 294 controls an amount of fluid output by the hydraulic cylinders 296.

The hydraulic cylinders 296 may be rigidly coupled to one another, shown by the dotted lines in FIG. 6. The hydraulic cylinders 296 may be referred to as a dual floating hub system. In operation, pressurized hydraulic fluid controlled by the variable fore solenoid operated valve 294 enters into each hydraulic cylinder 296, thereby opening the shifting latching mechanism (e.g., the latching mechanism 281). As shown in the illustrated embodiment, the latching mechanism 281 may include a key slot 300 that matches a complimentary feature on the completion equipment shifting profile to facilitate latching the shifting system 272 to the completion equipment shifting profile feature.

Figure 7:
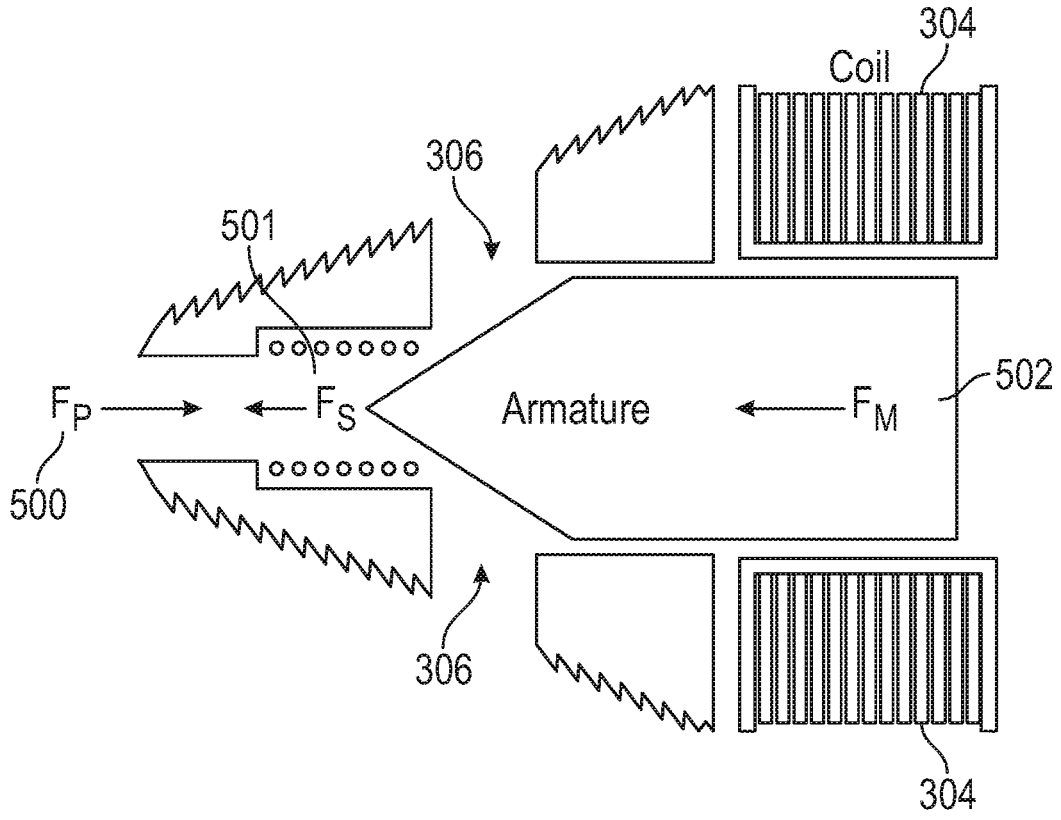
FIG. 7 is a diagram of a variable force solenoid valve of the shifter system used to actuate the latching mechanism of the FIG. 6, whereby the variable force solenoid valve is open, in accordance with an embodiment.

As shown in FIG. 7, an orifice opening of the variable force solenoid operated valve 294 is controlled by adjusting a current in the solenoid. In the illustrated embodiment, the variable force solenoid operated valve 294 is in an open configuration. However, in certain embodiments, the variable force solenoid operated valve 294 is in a closed configuration may also be used. The variable force solenoid operated valve 294 may provide a safety mechanism to equalize pressure within the shifting system 272 if power is lost.

As discussed in further detail below, there are three main forces that may determine the orifice opening of the variable force solenoid operated valve 294. For example, a first force may be from a hydraulic pressure (Fp) 500 in the hydraulic pump 282, a second force (Fs) 501 from a spring that determines a normal position of the variable force solenoid operated valve 294, and a magnetic force (Fm) 502 on a valve armature from the electromagnetic force from a coil 304. When the variable force solenoid valve 294 is open, the hydraulic fluid may flow into a tank 306.

Figure 8:
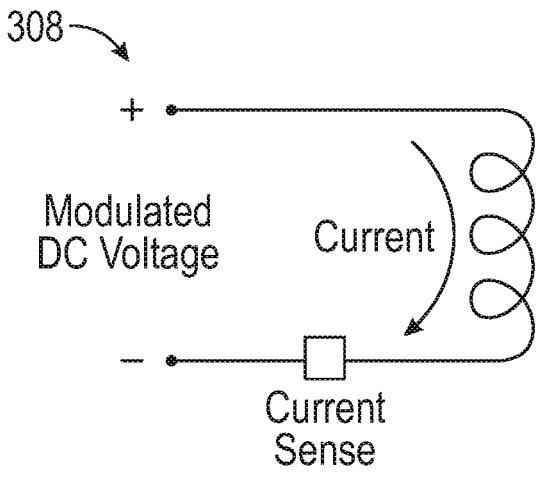
FIG. 8 is a diagram of a current feedback loop of the variable force solenoid valve, whereby the current feedback loop is controlled by a set DC voltage, in accordance with an embodiment.

The magnetic force (Fm) 501 may be controlled via a current feedback loop. For example, FIG. 8 illustrates an embodiment of a current feedback loop 308 that may be used to control the magnetic force (Fm) 501. Solenoids may generally be controlled by adjusting a DC voltage. Therefore, in certain embodiments, the current feedback loop 308 may be controlled by adjusting the DC voltage. This may be done by using a modulated voltage. The modulated voltage is a duty cycle method to change the time the voltage is turned on vs the time it is off. As such, the method disclosed herein allows the voltage to be adjusted within maximum voltage of the of the downhole power supply. The modulated voltage may be controlled by a desired set point of current, which is directly measured on the downhole electronics.

Figure 9:
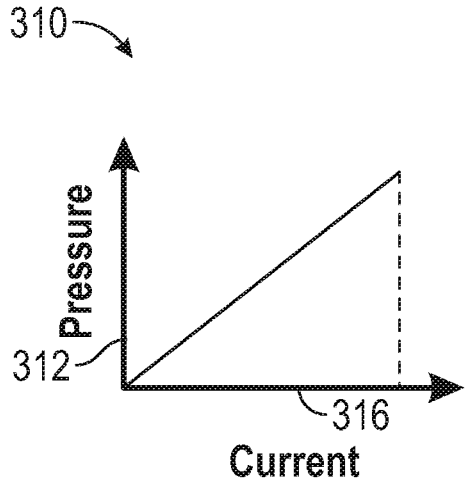
FIG. 9 is a plot of feedback pressure vs current associated with the varied force solenoid valve of FIG. 7, whereby the feedback pressure is linearly proportional to the current, in accordance with an embodiment.

FIG. 9 is a plot 310 of flowback pressure 312 as a function of current 316 illustrating a specific characteristic of the variable force solenoid valve 294. As illustrated, the flowback pressure 312 is linearly proportional to the current 316. The flowback pressure vs current profile may be programed into the downhole electronics system to associate flowback pressure and the current for adjusting to a desired flowback pressure. Accordingly, the variable force solenoid valve 294 may be hydraulically controlled and operates on a current feedback. The current is proportional to the desired pressure, or orifice opening, and is measured via a current sensor. The current may be selected based on controlling a modulated voltage.

Present embodiments include limiting a pressure going into the latching mechanism 281 to decrease, or lighten, a radial force applied to the latching mechanism. In certain embodiments, a variable force solenoid operated valve, also known as a proportional relief valve, may be used to control the pressure going into the latching mechanism. The variable force solenoid operated valve is part of a shifting hydraulic system and may be hydraulically controlled. Generally, the variable force solenoid operated valve is open and operates based on a current feedback. The current is proportional to the desired pressure, or orifice opening, and is measured via a current sensor. The desired current may be set based on controlling a modulated voltage.

Figure 10:
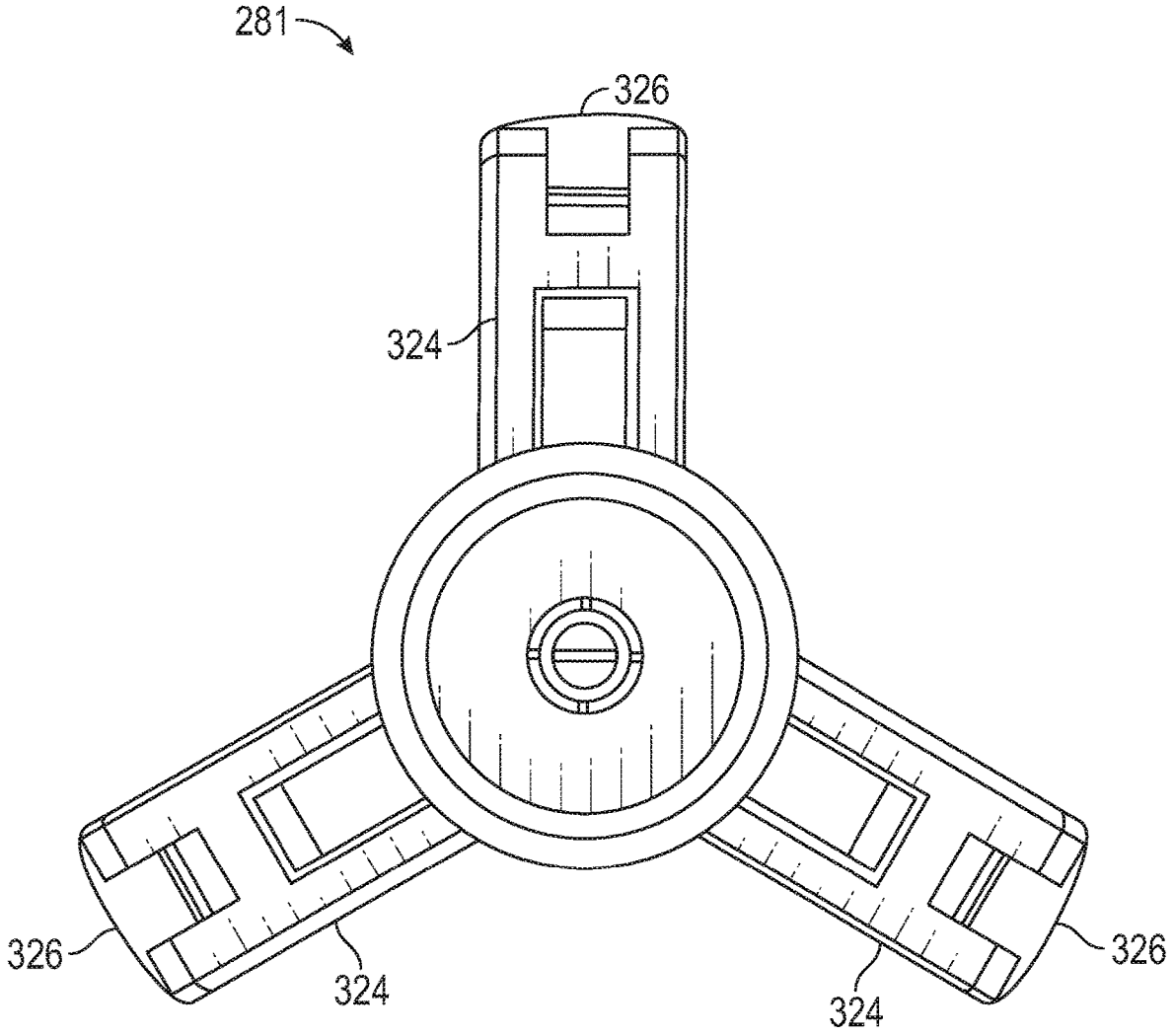
FIG. 10 is a top view of the shifter system of FIG. 2 having a multi-arm latching system operated by the dual floating hub system and variable pressure solenoid operated valve of FIG. 6, whereby a multi-arm latching system enables centralization of the service tool prior to latching the service tool to a tubular, in accordance with an embodiment.

As discussed above, shifting system includes a latching pad to facilitate latching, or coupling, the shifting system to a completion product shifting profile. When latching the shifting system to the completion product shifting profile, it may be desirable to centralize the shifting system. It has been presently recognized that by using a dual floating hub mechanism to actuate multiple sets of latching pads and/or anchor arms, better centralization, larger radial expansion ratios, and fail safe conditions for both run in and run out of a tubular may be achieved. FIG. 10 is a top view of an embodiment of a latching mechanism 281 (of shifting system 272) having three sets of linkage arms 324 and latching pads 326. While FIG. 10 is discussed in the context of a latching mechanism 281, the disclosed dual floating hub mechanism may be used with any other suitable service tool that includes an anchoring system to latch and/or anchor the service tool to a tubular. As discussed below, the shifting system 272 includes a dual floating hub mechanism to actuate the linkage arms 324 and the latching pads 326. The disclosed dual floating hub mechanism may use two pistons that operate on the same pressure line. As a pressure increases, the pistons may move to a center of the latching mechanisms 281. Movement of the pistons to the center of the shifting system 272 may activate the linkage arms 324 such that the linkage arms 324 radially expand, or open, until the latching pads 326 come in contact with the tubular (e.g., casing/tubing) or a valve shifting profile feature being manipulated. Having greater than two linkage arms 324 may facilitate centralizing the latching mechanism 281 while also decreasing a radial force to maintain the latching mechanism 281 latched to the tubular or profile feature. Accordingly, a lower force may be used to pull open the linkage arms 324 through the tubular.

As discussed above service tools, such as the shifting system 270, the anchor system 274, and the linear actuator system 280, may use hydraulic pistons to actuate anchoring/latching systems that grip or latch at least a portion of the service tool to a tubular or provide axial push/pull force. Hydraulic pistons may be useful in applications such as moving large loads using heavy equipment. In general, hydraulic pistons are controlled by an operator who visually observes the extension and position of the hydraulic cylinder and operates the control mechanism accordingly. However, such an approach may be inaccurate and result in damage of hydraulic equipment and the tool being used. Moreover, operator controlled hydraulic pistons may not be used in operations in which the operator is unable to see the hydraulic cylinder. Accordingly, it has been recognized that by using displacement sensors to measure a position of the hydraulic piston in the hydraulic cylinder, the undesirable effects of operator controlled hydraulic pistons may be mitigated.

There are various types of displacement sensor that may be used to measure a relative position of the piston in the hydraulic cylinder. However, displacement sensors that remotely measure absolute displacement in harsh environments with a suitable degree of reliability may be complex and costly. For example, present technologies may use magnetostrictive sensors that use time of flight of a mechanical signal along a pair of fine wires encased in a sealed metal tube. The mechanical signal may be reflected back from a magnetostrictively induced change based on an actuator rod's mechanical properties.

Additional technologies that may be used include an absolute rotary encoder which is a sensor that senses rotation. Translational to rotary conversion is generally performed using gears or a cable/tape that may be uncoiled from a spring loaded drum. Absolute encoders tend to suffer from limited range and/or resolution. Harsh environments that include levels of vibration generally exclude absolute etched glass scales from consideration due, in part, to critical alignment requirements, susceptibility to brittle fracture, and intolerance to fogging and dirt. In addition, this particular technology may need re-zeroing of frequencies.

Moreover, infrared displacement techniques used for calculating translation of a cylinder by integrating a volumetric flow rate into the cylinder over time may have several difficulties. For example, devices that employ these particular techniques may be incremental and/or require frequent, manual measuring variables to provide an accurate displacement measurement. Furthermore, integrating flow to determine displacement may result in inaccuracy of measurements and is limited by a dynamic sensing range of the flow measurement sensing technology. Flows that may be above or below the dynamic sensing range may be error prone. Accordingly, it is presently recognized that using a linear displacement sensor that uses a load cell and a return compressive spring within the hydraulic cylinder to determine a position of the piston with respect to the hydraulic cylinder may mitigate the undesirable effects of infrared displacement techniques and improve the accuracy of the measurements. In the disclosed embodiments, a displacement of the piston may be linked to the spring deflection. The deflection of the spring is proportional to the compressed force, displacement of the hydraulic piston may be measured using a load cell and processing signal unit. The present embodiments of the linear displacement technique may not be limited to downhole tools and hydraulic cylinder applications. The disclosed system and method may be used in combination with other load cell devices, and a spring, tensile, or compressive technique may be used as a displacement sensor as described in further detail below.

Service operations may include well intervention, reservoir evaluation, and pipe recovery. When performing these service operations, a service tool, such as the tool 26 may be lowered into the hydrocarbon reservoir (e.g., wellbore 30). Temperature and pressure of the hydrocarbon reservoir may be above a threshold for certain sensors. For example, in certain embodiments, a pressure and temperature of the hydrocarbon reservoir may be at or above approximately 20,000 pounds per square inch (psi) and above approximately 350° C. The pressure and the temperature of the hydrocarbon reservoir may be above pressures and temperatures that are suitable for using displacement sensors having small packaging (e.g. approximately 1.5 inches and 3.5 inches, travel over 6 inches, and an ability to withstand 20,000 psi of hydrostatic pressure and temperatures of up to approximately 350° F.). However, by using a service tool having a load cell and spring such that tensile and compressive forces may be used as a displacement sensor, a position of a piston rod with respect to a hydraulic cylinder may be determined with improved accuracy compared to certain existing techniques.

Figure 11:
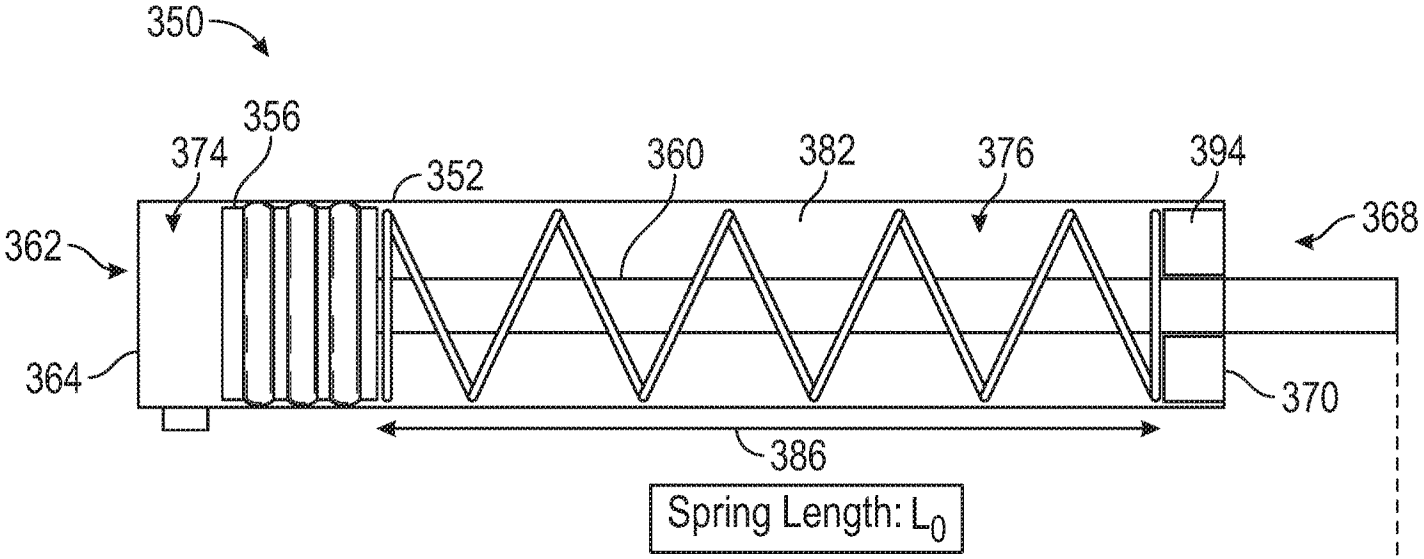
FIG. 11 is a diagram of a hydraulic cylinder for use with the service tool of FIGS. 1 and 2, whereby the hydraulic cylinder includes a compressive spring and a loadcell used as a displacement sensor to measure a position of a piston relative to the hydraulic cylinder using spring characteristics and load cell output, the compressive spring being in the uncompressed configuration, in accordance with an embodiment.
Figure 12:
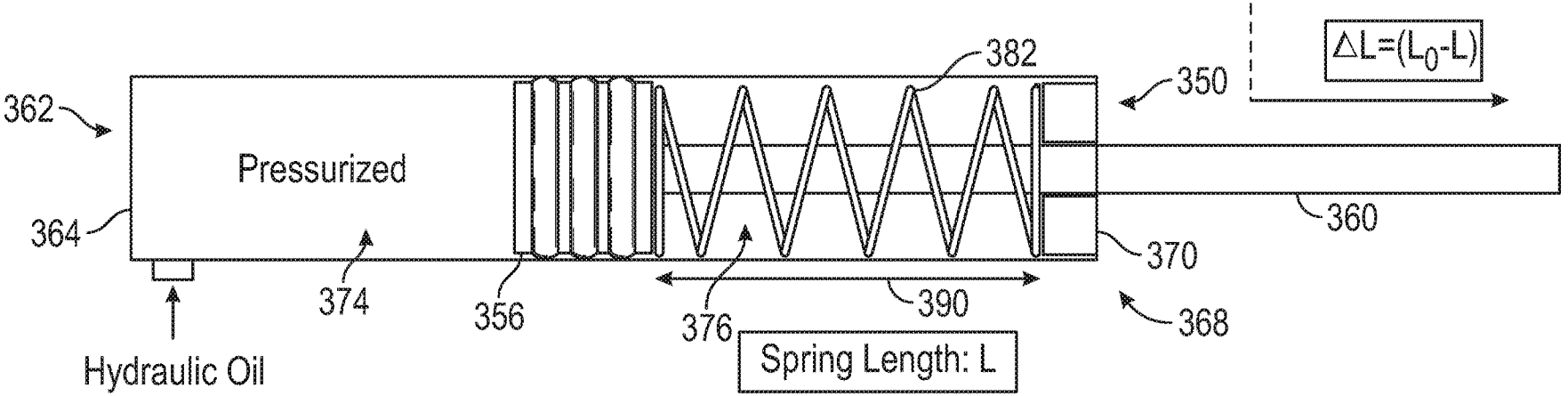
FIG. 12 is a diagram of the hydraulic cylinder of FIG. 11, whereby the compressive spring is in the compressed configuration, in accordance with an embodiment.

As discussed above, a hydraulic cylinder is a mechanical actuator that may be used to give a unidirectional force through a unidirectional stroke. Hydraulic cylinders may be used in a variety of applications, notably in construction equipment (engineering vehicles), manufacturing machinery, and civil engineering. Pressurized hydraulic fluid such as, for example, oil may provide power to hydraulic cylinders. Referring now to FIGS. 11 and 12, a hydraulic cylinder 350 includes a cylinder barrel 352, in which a piston 356 connected to a piston rod 360 moves back and forth relative to the cylinder barrel 352. The cylinder barrel 352 is closed at a first end 362 by a cylinder bottom 364 (also called the cap) and a second end 368 of the cylinder barrel 352 is closed by a cylinder head 370 (also called the gland) where the piston rod 360 comes out of the hydraulic cylinder 350. The piston 356 may include sliding rings and seals to block leakage of the fluid and maintain pressure. The piston 356 may divide the inside of the hydraulic cylinder 350 into two chambers, the bottom chamber 374 (cap end) and the piston rod side chamber 376 (rod end/head end). FIG. 11 illustrates the piston 356 in a non-displaced configuration. FIG. 12 illustrates the piston 356 in the displaced configuration.

A spring return cylinder incorporates a compressive spring 382 that drives the piston rod 360 back to one side if no pressure is applied to the piston 356. In certain embodiments, rather than using a compressive spring 382, the spring may be a tensile spring. Displacement of the piston rod 360, ΔL, may be linked to deflection of the spring 382. A relative displacement of the piston rod 360 (ΔL) may be equal to an initial length (L0) 386 of the spring minus a compressed length L 390 illustrated in FIG. 12. Following Hooke's Law, the force exerted by the compressive spring 382 is proportional to the spring deflection ΔL. The proportional constant k, is called the spring constant. It can be represented in an equation as F=kΔL, where F is the force exerted by the compressive spring 382, k is the spring constant and ΔL is the spring deflection.

Accordingly, the displacement of the piston 356 and the piston rod 360 (e.g., ΔL), which is also the deflection of the compressive spring 382 may be deduced by measuring the compressive force F exerted by the compressive spring 382 and by using the spring constant k. The spring constant may depend on the spring geometry and material properties and can be computed using common formula and is usually provided by the manufacturer of the spring. Therefore, the displacement of the piston rod 360, ΔL, is equal to the force exerted by the compressed spring F divided by the spring constant k, and is represented accordingly to the following equation:

$$\Delta L = F/k. \quad \text{(EQ. 1)}$$

In the illustrated embodiment, a load cell 394 is coupled to the compressive spring 382 of the hydraulic cylinder 350 to measure the compressed force of the spring F. The load cell 394 may be a transducer that is used to create an electrical signal whose magnitude is directly proportional to the force being measured. The electrical signal may be represented according to the following equation:

$$V_{meas} = \alpha F \quad \text{(EQ. 2)}$$

where F is the force applied, α is the load cell gain constant, and $V_{meas}$ is the electrical signal created in Volt. The signal created is proportional to the measured force of the return compressive spring (e.g., the compressive spring 382) acting on the load cell 394. The compressive spring force is proportional to the spring deflection, which is also the displacement of the piston 356 and the piston rod 360, ΔL. Therefore, the electrical voltage created by the load cell 394 is directly proportional to the displacement of the piston rod 360. The electrical signal may also be represented according to the following equation:

$$V_{meas} = \alpha k \Delta L \quad \text{(EQ. 3)}$$

where is $V_{meas}$ the electrical signal measured by the load cell 394 in Volt, α is the load cell gain constant, k is the spring constant, and ΔL is the displacement of the piston 356 and the piston rod 360.

A signal processing unit such as a microcontroller may be used to acquire the created electric signal from the loadcell 394 and compute the displacement of the piston 356 and the piston rod 360. The displacement may be determined from the following equation:

$$\Delta L = V_{meas}/(\alpha k) \quad \text{(EQ. 4)}$$

where ΔL is the displacement of the piston rod, $V_{meas}$ is the electrical signal measured by the load cell 394 in Volt, α is the load cell gain constant, and k is the spring constant. In certain embodiments, the displacement measurement value of the piston rod 360 may be transmitted to a user interface for display or to another electronic system.

In an embodiment, the compressive spring 382 may be in an uncompressed configuration such that the position of the piston 356 is in a non-compressed configuration. Because the opening of the anchoring mechanism is proportional to the displacement of the piston rod, in the end, this method is used to measure the opening displacement of the anchoring mechanism.

Figure 13:
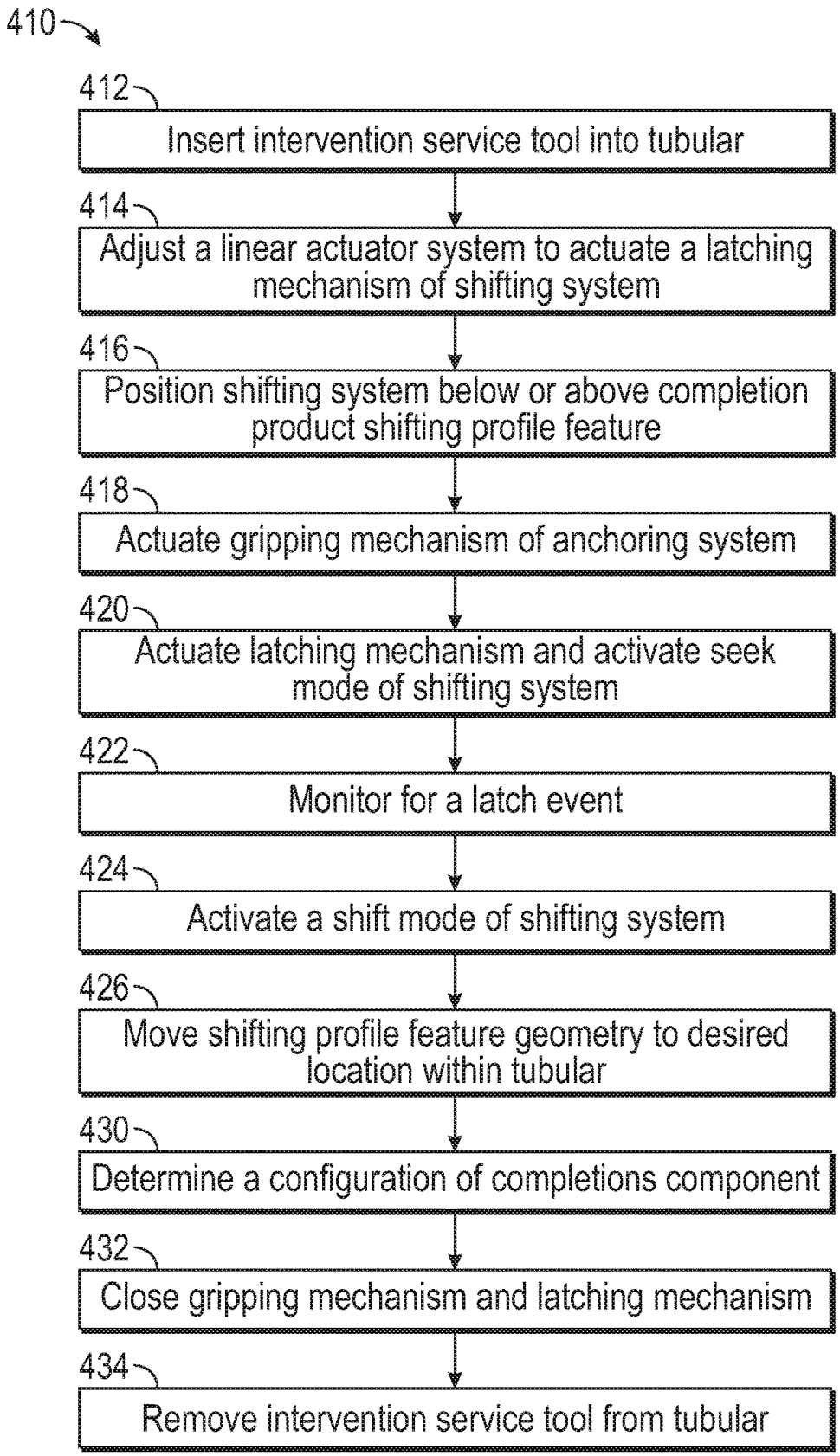
FIG. 13 is a flow diagram of a method for seeking and latching the service tool of FIG. 2 into a shifting profile geometry, in accordance with an embodiment.

Present embodiments also include a method for reliably and accurately seeking and latching the shifting system 272 of the service tool 270 into the completion product shifting profile feature. FIG. 13 is a process flow diagram illustrating an embodiment of a method 410 for seeking and latching a shifting system (e.g., the shifting system 272) into the completion product shifting profile. As illustrated, the method 410 includes inserting an intervention service tool into a tubular (block 412) and adjusting a linear actuator system to actuate a latching mechanism of a shifting system (block 414). For example, as discussed above, a linear actuator system (e.g., the linear actuator system 280) deploys and axially translates a latching mechanism (e.g., the latching mechanism 281) of the shifting system. The linear actuator system includes an actuator rod (e.g., the actuator rod 402) that provides a push force (e.g., a first axial input force) in a first direction to retract the latching mechanism, and a pull force (e.g., a second axial input force) in a second direction opposite the first direction to extend the latching mechanism. By adjusting the linear actuator, an operator of the service tool may move or secure the service tool within the tubular.

Following adjustment of the linear actuator system, the method 410 includes positioning the shifting system below or above the completion product shifting profile feature (block 416). Once the shifting system is positioned relative to the completion product shifting profile feature, the method 410 includes actuating a gripping mechanism of an anchoring system (block 418). For example, as discussed above, an anchoring system (e.g., the anchoring system 274) anchors/secures the intervention service tool to a tubular (e.g., the tubular 32). The linear actuator system may apply the push force to radially expand anchor arms (e.g., the anchor arms 42) of the gripping mechanism (e.g., the anchoring mechanism 40) and place the gripping mechanism in the open position. The anchor arms apply a radial force to a surface of the tubular, thereby anchoring the intervention service tool to the tubular.

Once the intervention service tool is anchored to the tubular, the method 410 includes actuating the latching mechanism and activating a seek mode of the shifting system (block 420). During the seek mode, the linear actuator system 280 (FIG. 2) applies the push/pull force to the latching mechanism 281 to adjust a radial force applied to the tubular by the latching mechanism 281 of the shifting system 272. As such, the latching mechanism 281 is compliant and may facilitate navigation through various internal features of the tubular as the latching mechanism 281 translates axially in response to the push/pull force applied by the linear actuator system 280. For example, inner dimensions of the tubular may vary along its length. As the intervention service tool 270 is translocated up and down the tubular seeking the completion product shifting profile, latching lengths (e.g., the latching arm 324) may expand and retract to adjust the radial force applied by the latching mechanism. In this way, the shifting system may navigate through the tubular to locate the compliant product shifting profile. While the disclosed method is described in the context of using a linear actuator system of locate or seek a completion latching profile, in certain embodiments, a wireline cable or wireline tractor is used.

The method 410 also includes monitoring for a latch event (block 422). For example, the intervention service tool may include one or more sensors (e.g., pressure sensors) on the shifting system that detect when the latching mechanism of the shifting system is latched onto the completion product shifting profile. As used herein, a "latch event" is intended to denote an event in which the latching mechanism is latched onto a completion component latch or a shifting profile geometry.

Once a latch event has been detected, the method 410 includes activating a shift mode of the shifting system (block 424). In shift mode, the radial force applied by the latching mechanism is increased to lock the shifting system to a completion component latch of the shifting profile geometry. Therefore, while in the shift mode, the shifting system becomes a rigid system rather than a compliant system, as in the seek mode. In the shift mode, the linear actuator is deployed to apply the push and/or pull force to move the shifting profile feature geometry and, therefore, open or close, respectively, the shifting profile feature geometry (a flow or isolation control device).

After the latch event is detected and the shifting system is locked to the completion component latch, the method includes moving the shifting profile feature geometry to a desired location with the tubular (block 426). The linear actuator system may translocate within the intervention service tool to move the shifting profile feature geometry from a first location to a desired second location that is different from the first location. In certain embodiments, the gripping mechanism may be reset if more than 12 inches are need to move the shifting profile feature geometry to the second location and complete the shifting operation.

The method 410 also includes determining a configuration of the shifting profile feature geometry (block 430). For example, the intervention service tool may include one or more sensors (e.g., pressure sensors) that may monitor for when the shifting profile feature geometry has reached an end of travel (e.g., the second location). The end of travel of the shifting profile feature geometry is indicative that the shifting profile feature geometry is either in a fully open configuration or a fully closed configuration.

Following determination of the configuration (e.g., fully open or fully closed) of the shifting profile feature geometry, the method 410 includes closing the gripping mechanism of the anchoring system and the latching mechanism of the shifting tool (block 432) and removing the intervention service tool from the tubular (block 434).

In essence, the above service tool includes multiple features that facilitate well intervention of wellbore operations. The disclosed system and methods improve the manner by which the service tool latches to completion profile feature and retains, or anchors, the service tool to a tubular. The tubular may be a portion of a casing or wellbore. In addition, features of the disclosed service tool may facilitate deploying and retracting moveable components of the service tool such the anchoring and latching tools.

The specific embodiments described above have been shown by way of example, and it should be understood that these embodiments may be susceptible to various modifications and alternative forms. It should be further understood that the claims are not intended to be limited to the particular forms disclosed, but rather to cover modifications, equivalents, and alternatives falling within the spirit of this disclosure.

The invention claimed is:

1. A service tool configured to be inserted into a tubular, the service tool comprising:

an anchoring system, wherein the anchoring system comprises:

a plurality of anchor arms that are self-centralizing;

a shifter assembly connected with the anchoring system, wherein the shifter assembly comprises a latching mechanism; and a hydraulic system to control the latching mechanism, the hydraulic system comprising a hydraulic power unit coupled to the latching mechanism, wherein the hydraulic power unit comprises a first hydraulic cylinder having a first piston, a second hydraulic cylinder having a second piston, a hydraulic pump, a pressure sensor, and a plurality of valves.

2. The service tool of claim 1, wherein the plurality of anchor arms comprise an inner pad coupled to a first linkage; an outer pad coupled to a second linkage; and a wedge positioned adjacent to the outer pad and the inner pad.

3. The service tool of claim 2, wherein the anchoring system comprises a body having a first end, a second end, and an opening extending along a portion of the body between the first end and the second end, wherein the wedge translocates relative to the body, and wherein the outer and inner pads contract and move radially away from the tubular and toward the body in response to an axial input force.

4. The service tool of claim 1, comprising a gripping assembly that comprises the plurality of anchor arms and a plurality of pins configured to couple the plurality of anchor arms in series such that each anchor arm of the plurality of anchor arms is coupled to an adjacent anchor arm, wherein each anchor arm is configured to pivot about the respective pin relative to the adjacent anchor arm.

5. The service tool of claim 4, wherein a first pin of the plurality of pins is fixed to the body at the first end and a second pin of the plurality of pins positioned at the second end of the body is moveable relative to the body.

6. The service tool of claim 1, comprising a gripping assembly that comprises a first pivot base fixed to the body adjacent to the first end and a second pivot base adjacent to the second end, wherein a first portion of the plurality of anchor arms is coupled to the first pivot base and a second portion of the plurality of anchor arms is coupled to the second pivot base, and wherein the second pivot base is configured to move relative to the body in response to a first axial input force and a second axial input force.

7. The service tool of claim 1, wherein the shifter assembly comprises the latching mechanism configured to latch the service tool to a completion component latch or a shifting profile geometry.

8. A service tool configured to be inserted into a borehole, the service tool comprising:

a shifter assembly, wherein the shifter assembly comprises:

a latching mechanism comprising a plurality of latching lengths configured to latch at least a portion of the service tool to a completion component latch or shifting profile geometry;

a first piston disposed within a body of the shifter assembly at a first end; and a second piston disposed within the body of the shifter assembly at a second end that is opposite the first end;

wherein when the service tool moves the completion component latch in a first axial direction, the first piston floats within the body such that the first piston is not in contact with the body at the first end and the second piston bottoms out at the second end, and wherein when the service tool moves the completion component latch in a second axial direction that is opposite the first direction, the second piston floats within the body such that the second piston is not in contact with the body at the second end and the first piston bottoms out on at the first end.

9. The service tool of claim 8, comprising a hydraulic system configured to control the latching mechanism, the hydraulic system comprises a hydraulic power unit coupled to the latching mechanism, wherein the hydraulic power unit comprises a first hydraulic cylinder, a second hydraulic cylinder, a hydraulic pump, a pressure sensor, and a plurality of valves configured to control a flow of fluid through the first hydraulic cylinder, the second hydraulic cylinder, or both, and wherein the first piston is positioned within the first hydraulic cylinder and the second piston is positioned within the second hydraulic cylinder.

10. The service tool of claim 9, wherein at least one valve of the plurality of valves is a variable force solenoid operated valve.

11. The service tool of claim 9, wherein the first piston, the second piston, or both are configured to move the latching lengths away from the body to latch the service tool to the completion component latch or the shifting profile geometry in response to a pressure with the first hydraulic cylinder and the second hydraulic cylinder.

12. The service tool of claim 8, wherein the latching mechanism comprises a key slot configured to engage with a complimentary feature on the completion component latch or the shifting profile geometry during latching of the service tool to the completion component latch or the shifting profile geometry.

13. A method for latching a service tool into a shifting profile geometry disposed within a tubular in a hydrocarbon reservoir, the method comprising:

positioning an intervention service tool comprising an anchoring system, a shifting system, a linear actuator system such that the shifting system is above or below the shifting profile geometry, and wherein the shifting profile geometry is disposed within the tubular at a first location, and a hydraulic system to control a latching mechanism, the hydraulic system comprising a hydraulic power unit coupled to the latching mechanism, wherein the hydraulic power unit comprises a first hydraulic cylinder having a first piston, a second hydraulic cylinder having a second piston, a hydraulic pump, a pressure sensor, and a plurality of valves;

actuating the latching mechanism of the shifting system, wherein actuating the latching mechanism comprises applying an axial input force to the latching mechanism using the linear actuator system, wherein the axial input force radially expands or radially contracts latching lengths of the latching mechanism, and wherein the latching lengths exert a radial force when actuated;

adjusting the radial force exerted by the latching lengths of the latching mechanism to locate the shifting profile geometry, wherein the latching mechanism is adjustable to accommodate different inner dimensions of the tubular when the shifting profile geometry is being located;

locking the shifting system to the shifting profile geometry, wherein the radial force exerted by the latching lengths is increased to lock the shifting system to the shifting profile geometry;

positioning the shifting profile geometry at a second location that is different from the first location; and removing the intervention service tool from the tubular after positioning of the shifting profile geometry at the second location.

14. The method of claim 13, comprising actuating a gripping mechanism of the anchoring system to anchor the intervention service tool to the tubular after positioning the shifting system.

15. The method of claim 14, wherein removing the intervention service tool from the tubular comprises deactivating the latching mechanism and the gripping mechanism after positioning of the shifting profile geometry.

16. The method of claim 15, comprising determining an end of travel of the shifting profile geometry from the first location to the second location using one or more sensors before deactivating the latching mechanism and the gripping mechanism.

17. The method of claim 13, comprising monitoring for a latch event when the radial force is adjusted to locate the shifting profile geometry using one or more sensors positioned on the shifting system, wherein the latch event is indicative that the latching mechanism is latched onto the shifting profile geometry.

18. The method of claim 13, wherein the linear actuator system comprises a linear actuator, a wireline cable, or a wireline tractor.

19. The method of claim 13, wherein when the intervention service tool moves the shifting profile geometry in a first direction, the first piston floats within a body of the shifting system such that the first piston is not in contact with the body at a first end and the second piston bottoms out at the second end, and wherein when the intervention service tool moves the shifting profile geometry in a second direction, the second piston floats within the body such that the second piston is not in contact with the body at the second end and the first piston bottoms out at the first end.

* * * * *